US005540584A

United States Patent [19]

Greco

[11] Patent Number: 5,540,584

[45] Date of Patent: Jul. 30, 1996

[54] VALVE CAM ACTUATION SYSTEM FOR REGENERATIVE THERMAL OXIDIZER

[75] Inventor: Darren Greco, Princeton, N.J.

[73] Assignee: Cycle-Therm, Matawan, N.J.

[21] Appl. No.: 382,909

[22] Filed: Feb. 3, 1995

[51] Int. Cl.[6] ..... F27D 17/00

[52] U.S. Cl. ..... 432/181; 432/179; 110/211; 137/309

[58] Field of Search ..... 432/179, 180, 432/181; 110/211; 137/309, 311

[56] References Cited

U.S. PATENT DOCUMENTS

| | | | |
|---|---|---|---|
| 1,556,810 | 10/1925 | Turner | 137/309 |
| 1,597,365 | 8/1926 | Keigley et al. | 137/309 |
| 3,634,026 | 1/1972 | Kuechler et al. . | |
| 3,870,474 | 3/1975 | Houston | 432/180 |
| 4,012,191 | 3/1977 | Lisankie et al. | 432/179 |
| 4,180,128 | 12/1979 | Fallon, Jr. et al. | 432/180 |
| 4,470,806 | 9/1984 | Greco . | |
| 4,516,934 | 5/1985 | Nelson et al. | 432/30 |
| 4,666,403 | 5/1987 | Smith | 432/180 |
| 5,129,332 | 7/1992 | Greco . | |
| 5,221,522 | 6/1993 | Cash | 432/181 |
| 5,279,235 | 1/1994 | Greco . | |
| 5,352,115 | 10/1994 | Klobucar | 432/181 |
| 5,365,863 | 11/1994 | D'Souza | 432/181 |

FOREIGN PATENT DOCUMENTS

| | | | |
|---|---|---|---|
| 436585 | 11/1926 | Germany | 137/309 |
| 230125 | 3/1925 | United Kingdom | 432/180 |

*Primary Examiner*—Thomas E. Denion
*Attorney, Agent, or Firm*—Howard & Howard

[57] ABSTRACT

An inventive cam actuation structure provides a separate cam member for opening each of the valves in a regenerative thermal oxidizer. The separate cam structures allow the arrangement of the flow passages in any desired relationship relative to the other passages. In addition, the use of the separate cams allows great variability in the adjustment of the valve profiles relative to each other. Two valve actuation structure embodiments are disclosed. In a second feature of this invention, the inlet manifold is received within the outlet manifold. The heated gas in the outlet manifold preheats the gas in the inlet manifold, ensuring that impurities will not liquify within the inlet manifold. In a further feature of this invention, gravitational controls are used for the purge valve. A connection between the inlet valve and the weights for opening the purge valve ensures that the purge valve will not be opened when the inlet valve is opened.

21 Claims, 5 Drawing Sheets

VALVE CAM ACTUATION SYSTEM FOR REGENERATIVE THERMAL OXIDIZER

BACKGROUND OF THE INVENTION

This invention relates to a valve actuation system for independently actuating each of the valves associated with the flow passages in a regenerative thermal oxidizer.

Regenerative thermal oxidizers ("RTOs") are used to remove pollutants from an industrial gas stream. In particular, RTOs are often utilized to remove volatile organic compounds from a gas stream. In a basic RTO structure, several heat exchangers are each communicated with a common combustion chamber. Each of the heat exchangers receives at least an inlet passage and an outlet passage. The several inlet passages are all connected to an inlet manifold, and the several outlet passages are all connected to an outlet manifold. Valves are placed on each inlet passage and each outlet passage. A supply of air to be cleaned is communicated through the inlet manifold, and the inlet valve on one of the inlet passages is opened to allow the flow of that air through the heat exchanger and into the combustion chamber. The air typically carries pollutants and will be referred to as "dirty" air for purposes of this application. At the same time, cleaned air from the combustion chamber passes through a second of the heat exchangers through an open outlet valve and to the outlet manifold. The valves are cyclically moved between their respective heat exchangers being in an inlet mode and in an outlet mode to continuously process dirty gas.

The air passing through inlet passage, the heat exchanger and into the combustion chamber is heated by the previously heated heat exchanger elements. The cool air to be cleaned cools the heat exchanger. The hot air leaving the combustion chamber heats the previously cooled heat exchanger, thus reheating the heat exchanger for use to heat the air to be cleaned in the next cycle.

Problems exist in properly timing the opening and closing of the several valves. While pneumatic or electronic valve actuation controls have been utilized in these systems, the inherent unreliability in such controls has let to problems. In particular, one must ensure that the inlets and outlet valves are never commonly opened on any one heat exchanger. If both valves were opened on any one heat exchanger, dirty air could flow from the inlet manifold directly to the outlet manifold. The outlet manifold is typically connected to atmosphere, and the connection of the dirty air to be cleaned to the outlet manifold is undesirable.

Mechanical valve actuation systems have been used that typically utilized a single cam member controlling the valves for each of the several heat exchangers. The prior art mechanical valve controls for an RTO system have typically been limited due to the use of a single cam to actuate each of the valves. The single cam reduces the ability to vary the opening and closing of the valves relative to each other. In some applications it may be desirable to change the respective opening and closing times of the valve between the inlet and outlet valves. The prior art mechanical valve actuation systems have not provided sufficient flexibility in this regard.

In the prior art, the single cam has been used, since it has been thought necessary to ensure that the valves are never improperly opened, leading to a leakage situation. However, the use of the single cam puts severe restrictions on the arrangements of the flow passages leading from both the inlet and outlet manifolds.

In another problem with existing RTO systems, impurities will sometimes liquify out of the gas stream. In particular, contaminants such as resins or plasticizers are often found in the dirty air to be cleaned. These substances will often begin in the vapor form, but condense as the temperature drops on the way to the RTO system. In particular, these substances will often become a liquid as they enter the inlet manifold and head towards the inlet passage. The liquid tends to coat the inside walls of the inlet manifold duct work and is carried into the inlet valves. Once these impurities pass the inlet valves, they enter the heat exchanger and are revolatilized by the hot temperatures in the heat exchange chamber. However, prior to the impurities reaching the inlet valves, a problem is created in that the substances in their liquid state coat the manifold and cause a potential fire hazard and housing cleaning problem. Further, when the impurities coat the inlet valve seats, they may harden. The hardened impurities can create a crust along the inlet valve disk/valve seat interface, such that the valve disk will not fully close. This can result in leakage across the valve disk, which is undesirable.

In another problem in present RTO systems, it is desirable to ensure that a purge valve is not open unless the inlet valve is closed along with the outlet valve. In some prior systems, it has been possible to open the inlet and purge valve for a common period of time. With the increase in cost of fuel, this common opening has proven to be too inefficient for practical application.

SUMMARY OF THE INVENTION

In one disclosed embodiment of this invention, an RTO includes a plurality of heat exchangers. Each of the heat exchangers preferably includes an inlet passage and an outlet passage, with the several inlet passages all connected to a common manifold and the several outlet passages also all connected to a common manifold. Inlet valves are placed on each inlet passage and outlet valves are placed on each outlet passage. The valves are preferably rotary disc valves. In an inventive feature of this invention, a separate cam-driven actuation element is associated separately with each of the inlet and outlet valves. More preferably, a single shaft drives all of the cams associated with each of the valves for the RTO system.

Most preferably, the actuation time for the valve by the actuation member is adjustable. In a preferred embodiment, the actuation member includes a member moving with the cam that is connected in a loss motion connection to a valve actuation element. In one example, the moving member is a rod moving within a cylinder. The cylinder is connected to open and close the valve. The rod includes a stop member that begins to pull the cylinder during a portion of its movement. That pulling force moves the cylinder to rotate the valve to open. The moving rod preferably has a limited degree of free movement before it begins to pull the cylinder. This allows the cam to rotate through its entire 360 degree rotational cycle, while only actuating the valve to open through a limited portion of the cycle. The portion of the cycle in which the valve is opened is adjustable with the inventive system.

In a further feature of this invention, a bias force holds the valve closed when the moving member is not pulling the cylinder to open the valve. In one example, the moving member is a rod that slides within a hollow cylinder. The cylinder is connected to a valve cam shaft actuation structure. In this particular embodiment, the valve cam shaft actuation structure is further connected to a weight. The weight creates a downward force that closes the valve. The pulling force on the cylinder overcomes the bias force of the weight and opens the valve during a portion of the cycle of each cam.

In another embodiment, a spring biases a moving cylinder which moves with the cam relative to a rod. The rod is fixed to a valve actuation lever. As the cylinder moves through the portion of its rotational cycle during which it is not opening the valve, the spring ensures that the lever is biased to a position wherein it holds the valve closed. Eventually, the cylinder begins to move the rod, which overcomes the bias force, opening the valve.

In one other inventive feature of this invention, the inlet manifold is fully received within the outlet manifold. The outlet manifold contains superheated air that ensures the impurities within the dirty gas flowing through the inlet manifold do not become liquid. Rather, the heat from the outlet manifold preheats the gas in the inlet manifold, reducing or eliminating any tendency for impurities to become liquid in the inlet manifold.

In another feature of this invention, the purge valve is opened by gravitational force, however, it is prevented from opening during the inlet mode. Moreover, the arrangement and weight of the weights utilized to open the purge valve are chosen such that the suction created on the purge valve when the particular heat exchanger is in an outlet mode is sufficient to overcome the gravitational force, maintaining the purge valve closed. Thus, a unique gravitational drive for the purge valve is provided which ensures that the purge valve will not be open under either the inlet or outlet mode.

These and other features of the present invention can be best understood from the following specification and drawings, of which the following is a brief description.

DETAILED DESCRIPTION OF A PREFERRED EMBODIMENT

Figure 1A:
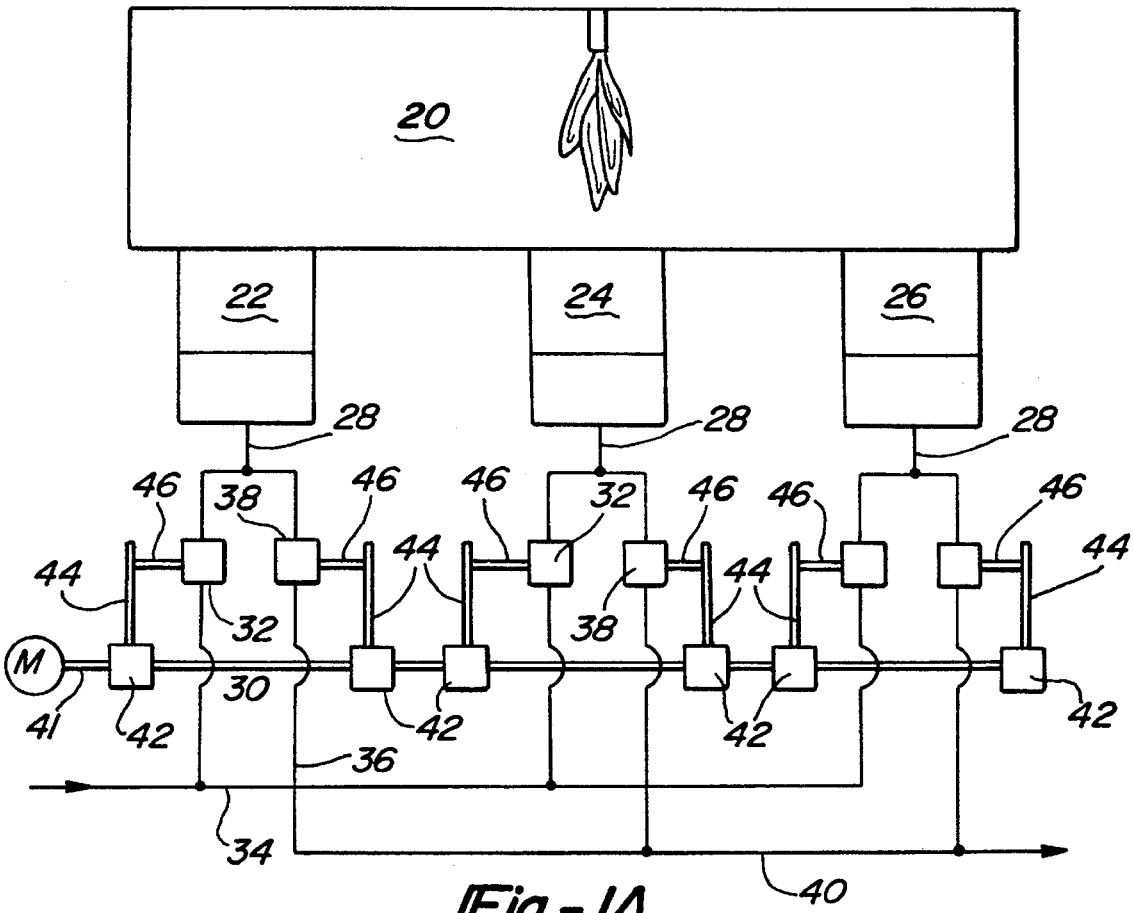
FIG. 1A is a schematic view of an RTO system incorporated in the present invention.

FIG. 1A shows an RTO system 19, which is illustrated in a highly schematic representation. A common combustion chamber 20 communicates with several heat exchangers 22, 24 and 26. Each heat exchanger is connected to a common flow passage 28. The flow passages 28 communicate with an inlet passage 30, which extends through an inlet valve 32. The inlet passages 30 all communicate with a common inlet manifold 34. Outlet passages 36 extend through an outlet valve 38 and are all connected to a common outlet manifold 40. As it is known, a dirty gas to be cleaned passes from inlet manifold 34, into one of the inlet passages 30, through an open inlet valve 32, and through one of the heat exchangers 22, 24 and 26 into combustion chamber 20. At the same time, a clean gas having been combusted in the combustion chamber 20 passes through another of the heat exchangers, through outlet passage 36, and through an open outlet valve 38 to the outlet manifold 40.

One aspect of the present invention relates to a method of actuating the valves 32 and 38. A common shaft 41 rotates a plurality of cam members 42, shown here schematically. Each cam 42 actuates an actuation structure 44 which rotates the valves 32 and 38. Since an actuation structure 44 and cam 42 is associated with each of the valves 32 and 38, the arrangement of the passages or valves is not dictated by the position of the cams, as was the case with the prior art. Moreover, the opening and closing of the valves relative to the other valves can be controlled completely independently. A motor drives the shaft 41. A speed reducer may be interposed between the electric motor and the shaft 41, although that is not illustrated in this figure.

Figure 1B:
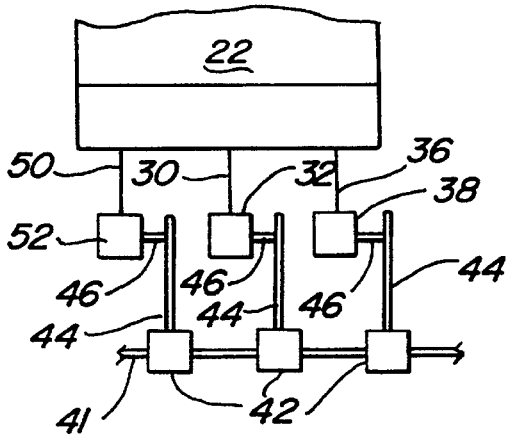
FIG. 1B is an enlarged view of one portion of an alternative RTO system.

FIG. 1B shows an alternative embodiment wherein a purge passage 50 passes through a purge valve 52. As shown here, a separate cam structure 42 and 44 is associated with the purge valve 52. It should be understood that there would be other heat exchangers in the system illustrated in FIG. 1B, and that those heat exchangers would have a similar valve actuation structure to that shown associated with heat exchanger 22 in FIG. 1B.

Figure 2:
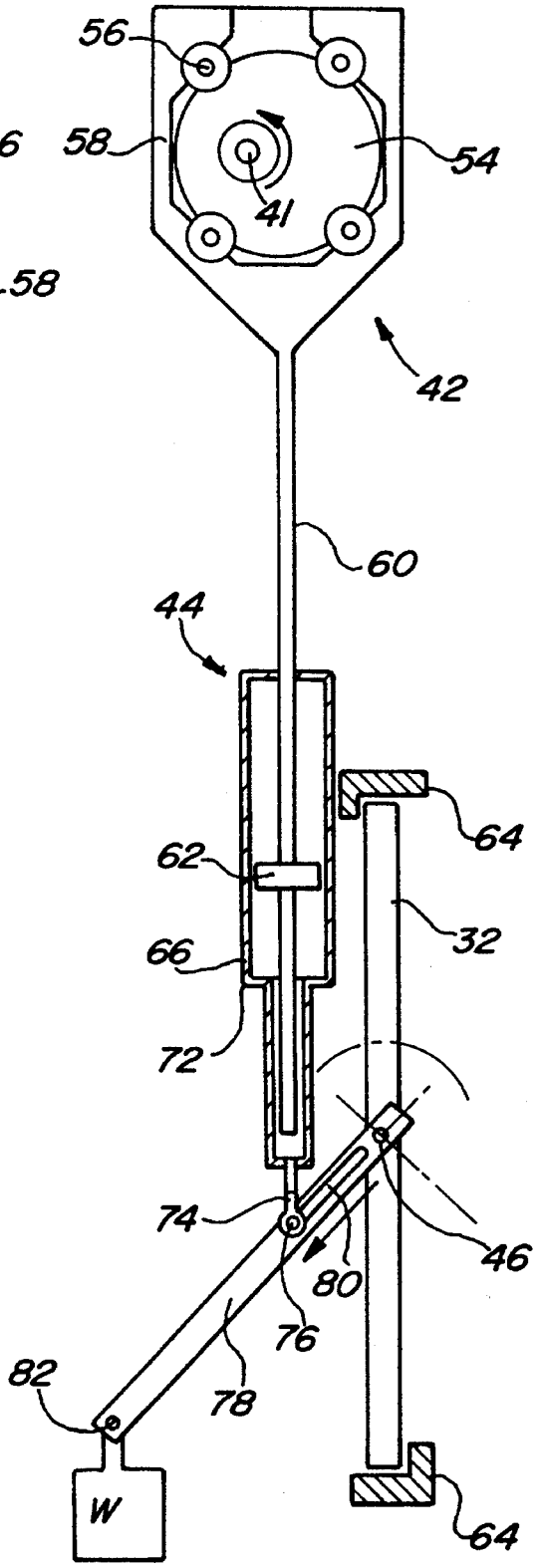
FIG. 2 is a view through a portion of a valve actuation structure.

FIG. 2 shows the details of the cam arrangement 42, actuation structure 44, and the valve rotating shaft 46. As shown, the cam arrangement 42 includes a rotary cam 54 fixed to rotate with shaft 41. The cam 54 is mounted eccentrically relative to the shaft 41. The cam further includes a plurality of cam rollers 56, which are received on each side of the rotary cam 54. The rollers 56 are attached to a bracket 58. As the cam 54 rotates, it moves bracket 58 upwardly and downwardly as shown in FIG. 2. A rod 60 is fixed for movement with bracket 58. A sliding stop 62 moves with rod 60. The relative position of sliding stop 62 on rod 60 is adjustable. A valve seat 64 receives the valve, here inlet valve 32, as is known in the art. A cylinder 66 receives the rod 60 and slide stop 62. An end of rod 60 extends into a guide cylinder 72. An opposed stop face 70 of cylinder 66 will be in contact with slide stop 60 through approximately 180 degrees of rotation of the rotary cam 54. When the cam has rotated counterclockwise approximately 90 degrees from the illustrated position, the slide stop 60 will initially contact the end face 70. Until that time, the cylinder 66 does not move with the moving rod 60. Thus, the valve 32 would remain closed, as will be explained below. At approximately 90 degrees of counterclockwise rotation from the illustrated position, the slide stop 62 abuts end face 70. Further rotation of the rotary cam 54 will begin to pull the slide stop 62, and consequently the cylinder 70 upwardly from the illustrated position. With this movement, the valve 32 will be rotated to an open position by moving clockwise in the illustrated position.

The cylinder 66 is connected by a rod 74 to a floating pin 76 attached to an actuation lever 78. As shown, pin 76 can slide within a slot 80 on actuation lever 78. However, upward movement of the cylinder 66 as explained above will tend to rotate the lever 78 clockwise, thus rotating shaft 46 and valve 32 clockwise to open the valve 32. As shown, a weight 82 biases the lever 78 counterclockwise to hold the valve 32 closed when the cylinder is in the illustrated position.

The complete cycle of the cam mechanism will now be disclosed with reference to FIG. 2. In the position shown in FIG. 2, the valve is maintained closed. The shaft 41 and rotary cam 54 will continue to rotate. After approximately 90 degrees of rotation, the slide stop 62 initially contacts end face 70. Continued rotation through the next 90 degrees causes the slide stop 62 to begin to pull against end face 70, and hence pull cylinder 66 upwardly. Of course, the force will not be directly axial force, but will be at an angle relative to that shown in figure. The sliding connection between pin 76 and slot 80 allows adjustments to accommodate the degree of this movement.

Eventually, the end of the stroke will be reached. At that time, the rod 60 and hence slide stop 62 will begin to move back downwardly right as shown in this figure. At that time, the bias force of the weight 82 will ensure that the end face 70 moves to the extent it can, and the valve 32 begins to move back to its closed position as quickly as possible.

By changing the position of the slide stop 62 relative to the rod 60, and by changing the orientation of the cam 54, one can easily tailor the movement of the valve 32 for any desired opening and closing profile. Also, one can vary the opening and closing profile of the inlet valve and the outlet valve or the purge valve relative to the other two. As such, the inventive system provides great additional flexibility when compared to the prior art systems.

Figure 3:
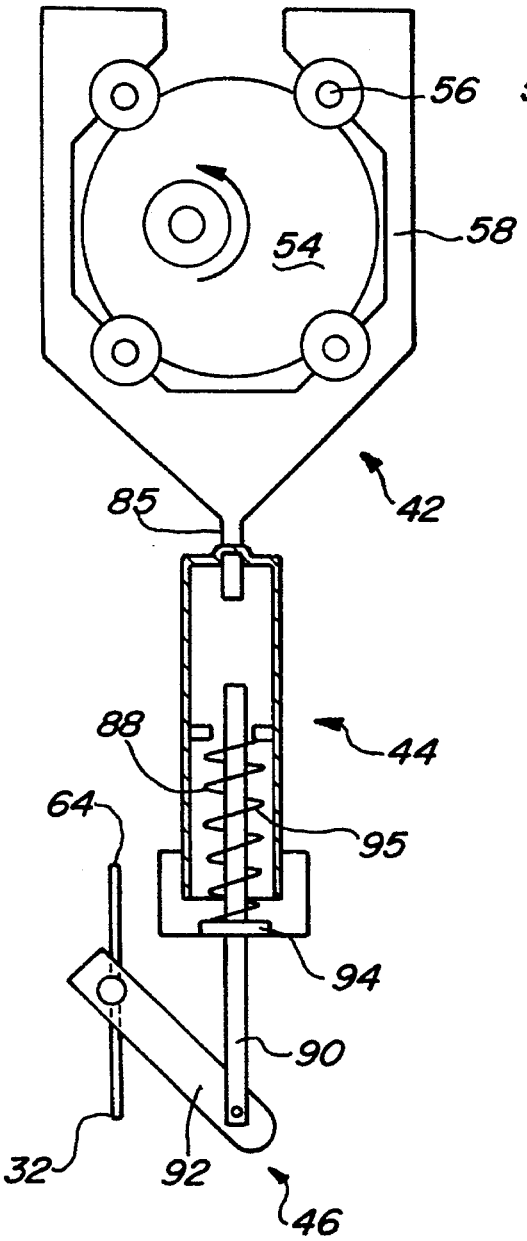
FIG. 3 shows an alternative valve actuation structure according to the present invention.

FIG. 3 shows an alternative actuation structure wherein the bracket 58 is connected to a rod 85. Rod 85 moves a cylinder 86 which includes a spring stop 87. Spring 88 is biased against spring stop 87, and forces a rod 90 outwardly of cylinder 84. Rod 90 is connected to the rotary lever 92 which is in turn fixed to cause the valve disc 32 to rotate between open and closed positions. As shown, an end member 94 of the rod 90 is biased by the spring 88 against an end face 95 of the cylinder 84.

As the valve rotates through its cycle, the cylinder 84 moves upwardly, pulling the end 94, and hence rod 90 upwardly. This causes lever 92 to rotate valve 32 open. As the cylinder 84 begins to move back downwardly, the spring 88 ensures that the end 94 is biased as far downwardly as is possible, thus insuring the valve disc 32 will close as rapidly as possible.

This aspect of the present invention improves upon the prior valve actuation structures by defining a separate cam member for each valve in the RTO system. This provides additional flexibility when compared to the prior an systems, and further allows the positioning of the flow passages at any orientation relative to the other flow passages. It also allows the adjustment of the opening and closing valve profiles for the system.

Figure 4:
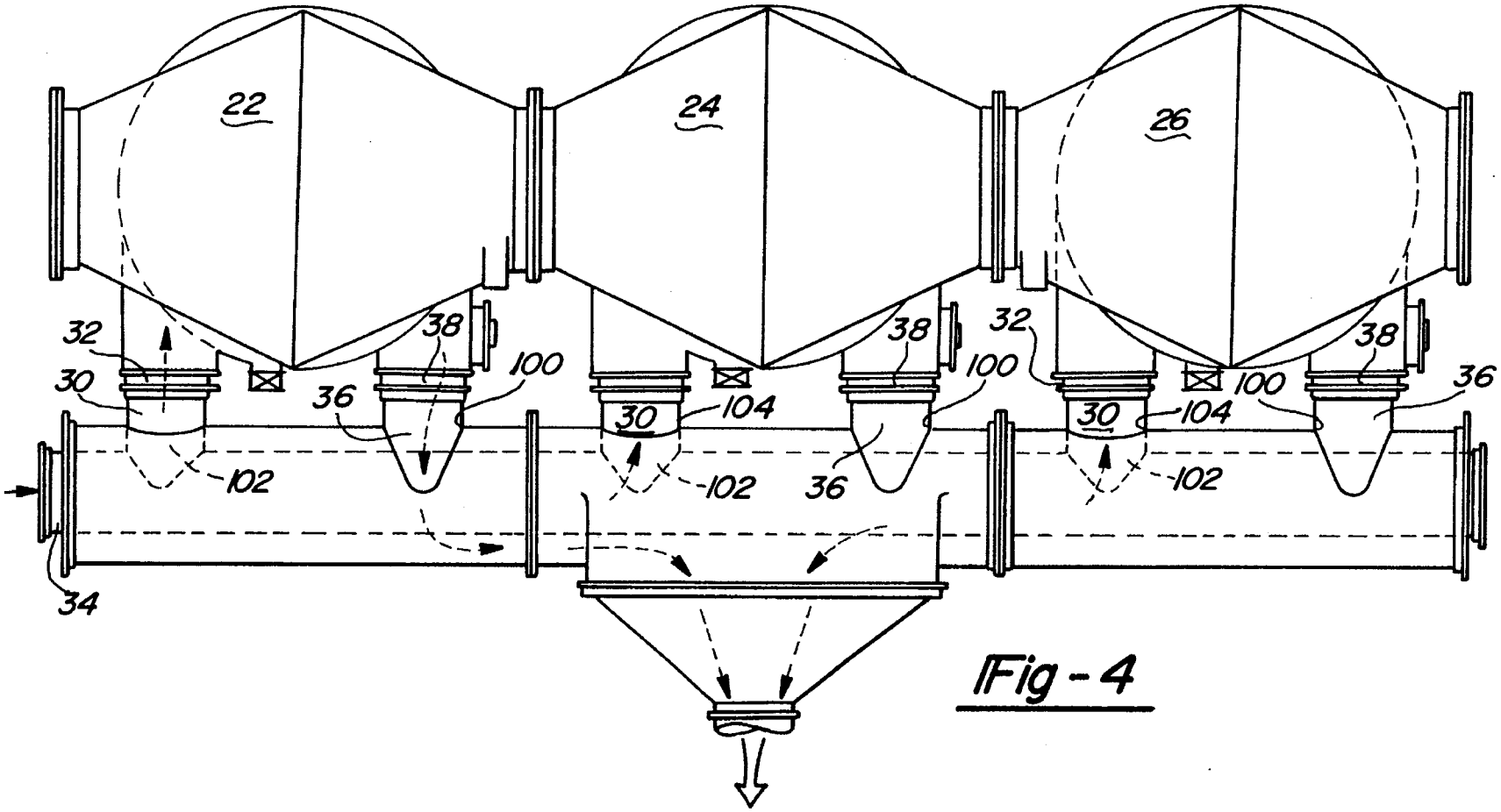
FIG. 4 shows a further feature of the present invention.

A second feature of the present invention is shown in FIG. 4. As shown in FIG. 4, the inlet manifold 34 is fully received within the outlet manifold 40. Thus, heated air leaving the several outlet passages and moving into the outlet manifold 40 preheats the air moving through the inlet manifold 34 on its way to one of the heat exchangers 22, 24 and 26. As shown, there are openings 102 in the outlet manifold 40 such that each of the inlet passages 30 can pass through the outlet manifold 40. Further, the outlet passages 36 merge into other openings 100 in the outlet manifold 40. This representation is somewhat schematic, however, a worker of ordinary skill in the art would be able to identify the particular seals necessary to achieve this relationship.

When cool air to be cleaned enters into inlet manifold 34 it is preheated by the previously combusted hot air in outlet manifold 40. Thus, there is no liquid condensing from the air flow in the inlet manifold 34, and the valve and inlet manifold will remain clean.

Figure 5A:
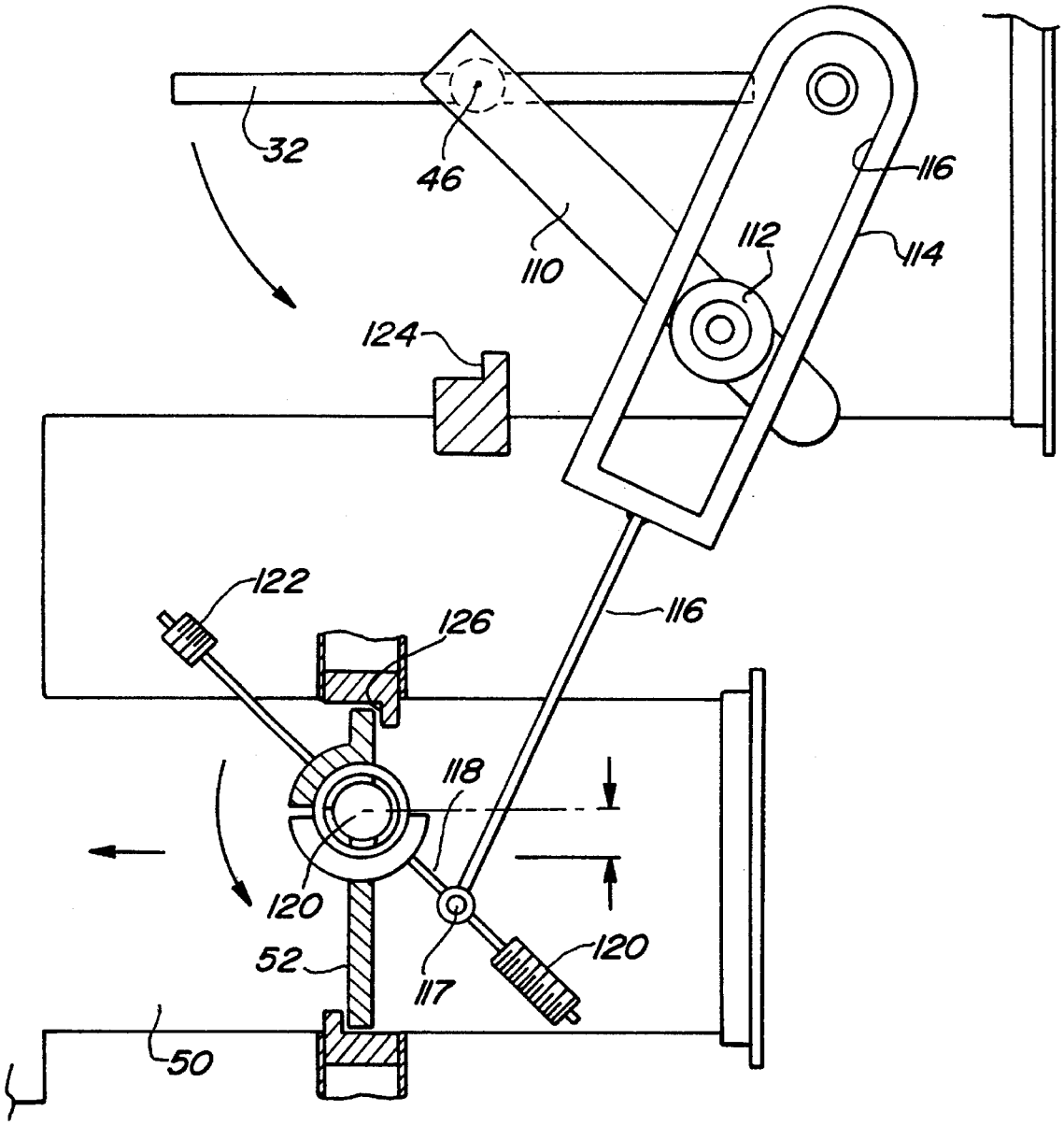
FIG. 5A shows a purge valve control in a first mode of operation.
Figure 5B:
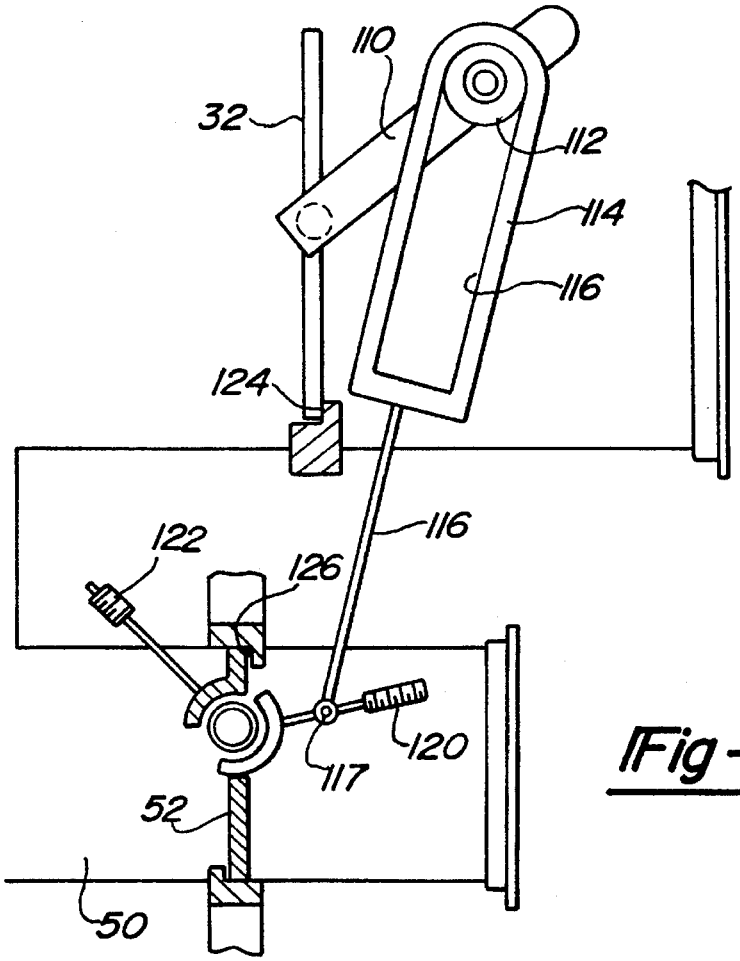
FIG. 5B shows a purge valve control in a second mode of operation.
Figure 5C:
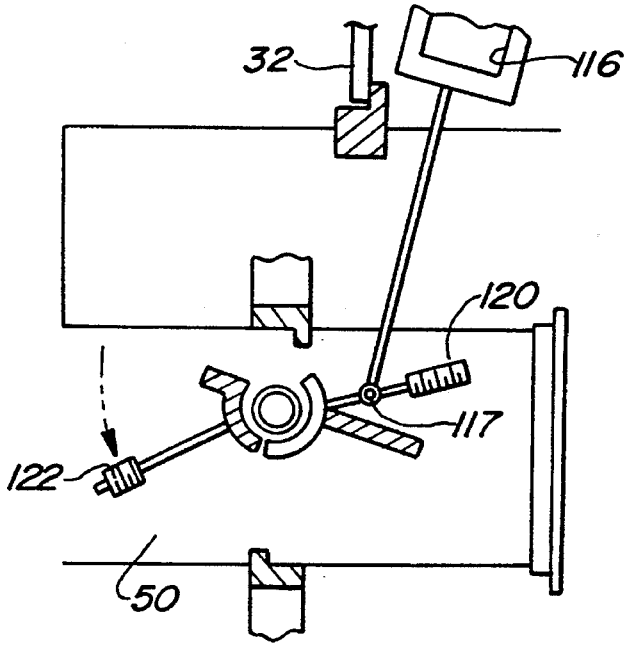
FIG. 5C shows a purge valve control in a third mode of operation.

A unique actuation structure for the purge valve 52 is illustrated in FIGS. 5A, 5B and 5C. FIG. 5A shows the positioning of the control for the purge valve when its associated inlet valve 32 is open. FIG. 5B shows the same purge valve in its position when the inlet valve 32 is closed, and the outlet valve is open. Finally, FIG. 5C shows the position of the purge valve 52 when both the inlet and outlet valves are closed. As shown in FIG. 5A, a lever 110 is connected to the actuation shaft 46 of the inlet valve 32. A pin 112 moves through a yoke 114 having a central groove 115 that allows movement of pin 112. As shown, inlet valve 32 is open, and pin 112 is in a lower extent of the groove 115. A rod 116 is connected to a pin 117 that is connected to a second rod 118. Second rod 118 is fixed for movement with a moving yoke 119 received on the shaft 120 for the purge valve 52. The yoke 119 may rotate relative to the shaft 120. A first weight 121 is received at one end of rod 118. A second weight 122 is positioned on a second rod 123 and connected to a fixed yoke 124. Fixed yoke 124 is fixed to shaft 120. Weight 121 is selected to be greater than weight 122. Thus, in the illustrated position, pin 112 is allowing yoke 114 to move downwardly in the direction as shown in FIG. 5A. Weight 121 rotates yoke 119 downwardly to the illustrated position. In this position, the end of yoke 119 abuts an end of fixed yoke 124, thus maintaining yoke 124 and weight 122 in the illustrated position. In this position, purge valve 52 is retained against its valve seat. Thus, in any situation where the inlet valve 32 is open, this arrangement will ensure that the purge valve 52 remains closed. There will be no loss of fuel or efficiency as there may have been in the past with previous gravitationally controlled purge valves.

As shown in FIG. 5B, inlet valve 32 has now closed. Pin 112 has been driven upwardly, and has lifted yoke 114 upwardly. Moving yoke 119 thus rotates counter-clockwise, and weight 120 is also lifted. In this position, the yoke 119 and weight 120 no longer maintain fixed yoke 124 at the position illustrated in FIG. 5A. In this position, weight 122 is free to rotate fixed yoke 124 downwardly, thus tending to open purge valve 52. However, in the illustrated position of FIG. 5B, the purge passage 50 is connected to a heat exchanger with an open outlet valve. The suction drawn on the line 50 due to the open outlet valve is sufficient such that the purge valve 52 is maintained closed. That is, the suction from the outlet line is sufficient to overcome the force from the weight 122.

In the position illustrated in FIG. 5C, inlet valve 32 is closed, and the outlet valve has also now been closed. This is the only situation where it is desirable for the purge valve 52 to open. The suction is no longer applied due to the closed outlet valve. In this position, the weight 122 rotates the fixed yoke 124, and drives the purge valve 52 to open. The air can now flow through the purge passage 50, to purge the heat exchanger as is known.

With the inventive arrangement, one ensures that the purge valve will not open unless both the inlet and outlet valves are closed. This is an improvement over the prior art gravitationally driven purge valves, both in cleaning efficiency, and in prevention of accidental leakage of dirty gas to the environment.

Preferred embodiments of this invention have been disclosed, however, a worker of ordinary skill in the art would recognize that certain modifications would come within the scope of this invention. For that reason, the following claims should be studied to determine the true scope and content of this invention.

I claim:

1. A regenerative thermal oxidizer comprising:

a combustion chamber;

a plurality of heat exchangers each communicating with said combustion chamber at one end;

an inlet passage communicating with a second end of each said heat exchanger, said plurality of inlet passages communicating with a common inlet manifold, said inlet manifold communicating with a source of gas to be cleaned;

an outlet passage communicating with a second end of each said heat exchanger, said outlet passages each communicating with an outlet manifold, said outlet manifold leading to a downstream location;

rotary valves associated with each of said inlet passages and each of said outlet passages;

a valve actuation cam arrangement, said valve actuation cam arrangement comprising a rotary shaft, and a plurality of cam members mounted for rotation with said rotary shaft, there being a separate cam member for each said valve; and, said cam members connected to a rotary valve actuation shaft for rotating said valve by an actuation structure, said actuation structure being configured to allow adjustment of the opening and closing profile of said valve relative to said cam, and said valve actuation structure being such that during a first portion of the rotational cycle of said shaft, said valve is actuated for movement, and through a second portion of the rotational cycle of said shaft, a portion of said valve actuation structure rotates without moving said valve.

2. A regenerative thermal oxidizer as recited in claim 1, wherein there is a single shaft driving all of said cam members.

3. A regenerative thermal oxidizer as recited in claim 1, wherein said actuation structure includes a first member moving with said cam that selectively abuts a portion of a second actuation member associated with said valve actuation shaft, said first member beginning to contact and move said second actuation member through a first portion of the rotational cycle of said shaft, and said first member moving relative to said second actuation member to leave said valve in a second position through a second portion of the rotational cycle of said cam shaft for each of said valves.

4. A regenerative thermal oxidizer as recited in claim 3, wherein a bias force biases said valve to a closed position during said second portion of said rotational cycle.

5. A regenerative thermal oxidizer as recited in claim 4, wherein said cam includes a plurality of rotating cam followers mounted about said rotary cam, said cam followers moving with a cam bracket, said cam bracket being fixed to move with said first actuation member.

6. A regenerative thermal oxidizer as recited in claim 4, wherein said first actuation member is a rod, said rod moving within a cylinder, said cylinder being said second actuation structure, said cylinder being connected to said actuation shaft.

7. A regenerative thermal oxidizer as recited in claim 4, wherein a weight is mounted to said lever to bias said valve to a closed position.

8. A regenerative thermal oxidizer as recited in claim 4, wherein said first actuation member is a cylinder including a stop face, said second actuation member being a rod moving within said cylinder, said rod having a collar selectively brought into contact with said stop face of said first actuation member, and said rod being fixed to move said actuation shaft to open said valve.

9. A regenerative thermal oxidizer as recited in claim 8, wherein said rod is spring biased to a location where it holds said valve closed by a bias force.

10. A regenerative thermal oxidizer as recited in claim 4, wherein said bias force is provided by a spring.

11. A regenerative thermal oxidizer as recited in claim 1, wherein said heat exchangers further include a purge passage for delivering a purge gas, and a rotary purge valve associated with each said purge passage.

12. A regenerative thermal oxidizer as recited in claim 11, wherein said cam shaft further including a separate cam for each of said purge valves.

13. A regenerative thermal oxidizer as recited in claim 11, wherein said purge valve is driven to be opened by a gravitational force.

14. A regenerative thermal oxidizer as recited in claim 13, wherein a connection is made between said inlet valve and said purge valve such that said purge valve is prevented from opening while said inlet valve is open.

15. A regenerative thermal oxidizer as recited in claim 14, wherein said connection between said inlet valve and said purge valve includes a first weight associated with a connection to said inlet valve, said first weight biasing said purge valve to a closed position when said inlet valve is open, said first weight being lifted by said connection to said inlet valve when said inlet valve is closed such that said first weight no longer biases said purge valve to a first position.

16. A regenerative thermal oxidizer as recited in claim 1, wherein said inlet manifold is received within said outlet manifold such that heat from said outlet manifold preheats gas flowing within said inlet manifold.

17. A regenerative thermal oxidizer comprising:

a combustion chamber;

a plurality of heat exchangers each communicating with said combustion chamber at one end;

an inlet passage communicating with a second end of each said heat exchanger, said plurality of inlet passages communicating with a common inlet manifold, said inlet manifold communicating with a source of gas to be cleaned;

an outlet passage communicating with a second end of each said heat exchanger, said outlet passages each communicating with an outlet manifold, said outlet manifold leading to a downstream location;

said outlet manifold being positioned about said inlet manifold such that said gas passing within said inlet manifold is preheated by heat from said gas in said outlet manifold; and said outlet manifold surrounding said inlet manifold, and said inlet passages extending radially outwardly through a wall of said outlet manifold.

18. A regenerative thermal oxidizer comprising:

a combustion chamber;

a plurality of heat exchangers each communicating with said combustion chamber at one end;

an inlet passage communicating with a second end of each said heat exchanger, said plurality of inlet passages communicating with a common inlet manifold, said inlet manifold communicating with a source of gas to be cleaned;

an outlet passage communicating with the second end of each said heat exchanger, said outlet passages each communicating with an outlet manifold, said outlet manifold leading to a downstream location;

a purge passage communicating with a second end of each said heat exchanger, said plurality of purge passages each communicating with a second end of each said heat exchanger, said plurality of purge passages each communicating with a common purge manifold; and a valve associated with each said inlet passage, each said outlet passage, and each said purge passage, said inlet and outlet valves including a cam actuated valve actuation control, said purge valve including a gravitational control for opening said purge valve when both said inlet and outlet valves are closed.

19. A regenerative thermal oxidizer as recited in claim 18, wherein there is a connection between said inlet valve and said purge valve that ensures said purge valve will not be open when said inlet valve is open.

20. A regenerative thermal oxidizer as recited in claim 19, wherein a first moving member is fixed to said inlet valve, and is in a first position relative to a second moving member when said inlet valve is opened, said second moving member being connected to a first weight, and said first weight maintaining said purge valve closed, and when said inlet valve is moved toward a closed position, said second moving member lifting said weight away from a position where it maintains said purge valve closed, such that said purge valve may open when said inlet valve is closed.

21. A regenerative thermal oxidizer as recited in claim 20, wherein said first weight is connected to a moving yoke that moves with a rotational shaft for said purge valve, and a second weight is fixed to move with said rotational shaft, said first weight being heavier than said second weight, such that said first weight maintains said purge valve closed when said inlet valve is opened.

* * * * *